US009121360B2

(12) United States Patent
Richter et al.

(10) Patent No.: US 9,121,360 B2
(45) Date of Patent: Sep. 1, 2015

(54) METHOD FOR OPERATING A FUEL INJECTION SYSTEM OF AN INTERNAL COMBUSTION ENGINE

(75) Inventors: Uwe Richter, Markgroeningen (DE); Rainer Wilms, Markgroeningen (DE); Matthias Schumacher, Weissach (DE); Joerg Kuempel, Stuttgart (DE); Matthias Maess, Boeblingen (DE)

(73) Assignee: ROBERT BOSCH GMBH, Stuttgart (DE)

( * ) Notice: Subject to any disclaimer, the term of this patent is extended or adjusted under 35 U.S.C. 154(b) by 1064 days.

(21) Appl. No.: 13/139,206

(22) PCT Filed: Dec. 7, 2009

(86) PCT No.: PCT/EP2009/066483

§ 371 (c)(1),
(2), (4) Date: Aug. 10, 2011

(87) PCT Pub. No.: WO2010/066663

PCT Pub. Date: Jun. 17, 2010

(65) Prior Publication Data

US 2011/0288748 A1 Nov. 24, 2011

(30) Foreign Application Priority Data

Dec. 11, 2008 (DE) ..... 10 2008 054 512

(51) Int. Cl.
*F02D 41/38* (2006.01)
*F02M 69/50* (2006.01)
(Continued)

(52) U.S. Cl.
CPC ..... *F02D 41/20* (2013.01); *F02D 41/2464* (2013.01); *F02D 41/345* (2013.01);
(Continued)

(58) Field of Classification Search
CPC ..... F02D 41/20; F02D 41/38; F02D 41/08; F02D 2041/2037; F02D 2041/2027; F16K 31/06; F16K 31/0689; G05B 7/02; G05B 13/021; F02M 47/00; F02M 51/00; F02M 59/36; F02M 59/46; F02M 2200/09; F02M 2200/315; F02M 51/061; F02M 51/0682; F02M 55/04; F02M 47/027; F02M 59/102; F02M 59/105; F02M 61/16; F02M 63/0015; F02M 2200/302; F02M 2200/306; F01L 2009/0486; F01L 13/0005; F01L 1/267; F01L 9/04; Y02T 10/44; Y02T 10/123; F02B 2275/16; H01F 2007/1888
USPC ..... 137/51, 55, 246.12, 246.16, 246.17; 123/456, 205, 357, 364, 375, 379, 381, 123/387, 390, 406.47, 445, 446, 447, 457, 123/458, 464, 482, 488
See application file for complete search history.

(56) References Cited

U.S. PATENT DOCUMENTS
4,213,181 A * 7/1980 Carp et al. ..... 701/115
(Continued)

FOREIGN PATENT DOCUMENTS
DE 101 48 218 4/2003
(Continued)

OTHER PUBLICATIONS
International Search Report for PCT/EP2009/066483, dated Feb. 4, 2010.

*Primary Examiner* — Lindsay Low
*Assistant Examiner* — John Bailey
(74) *Attorney, Agent, or Firm* — Keyon & Keyon LLP

(57) ABSTRACT

In a fuel injection system of an internal combustion engine fuel is delivered into a fuel rail by a high-pressure pump. The quantity of the delivered fuel is influenced by a quantity control valve operated by an electromagnetic operating device. At least one parameter of a braking pulse of the electromagnetic actuating device depends on an efficiency of the electromagnetic actuating device and/or on a supply voltage of a voltage source and/or on a temperature, in particular of a component of the fuel injection system or of the internal combustion engine.

12 Claims, 6 Drawing Sheets

(51) Int. Cl.

| | |
|---|---|
| ***F02D 41/20*** | (2006.01) |
| ***F02D 41/24*** | (2006.01) |
| *F02D 41/34* | (2006.01) |
| *F02D 41/40* | (2006.01) |

(52) U.S. Cl.

CPC ..... *F02D41/3845* (2013.01); *F02D 41/401* (2013.01); *F02D 2041/2027* (2013.01); *F02D 2041/2037* (2013.01); *F02D 2041/2055* (2013.01); *F02D 2200/0602* (2013.01)

(56) References Cited

U.S. PATENT DOCUMENTS

| | | | | |
|---|---|---|---|---|
| 4,370,954 | A * | 2/1983 | Asao et al. | 123/182.1 |
| 5,548,514 | A * | 8/1996 | Hasegawa et al. | 701/103 |
| 5,975,053 | A * | 11/1999 | Rodier | 123/446 |
| 6,237,573 | B1 * | 5/2001 | Onishi et al. | 123/506 |
| 6,332,455 | B1 * | 12/2001 | Sumida et al. | 123/490 |
| 6,382,532 | B1 * | 5/2002 | French et al. | 239/585.1 |
| 6,655,362 | B2 * | 12/2003 | Rembold et al. | 123/506 |
| 6,718,935 | B2 * | 4/2004 | Meisner et al. | 123/196 AB |
| 7,111,593 | B2 * | 9/2006 | Song et al. | 123/64 |
| 7,128,281 | B2 * | 10/2006 | Cho et al. | 239/585.1 |
| 7,249,590 | B2 * | 7/2007 | La Rosa et al. | 123/446 |
| 7,258,287 | B2 * | 8/2007 | Cho et al. | 239/585.1 |
| 7,387,289 | B2 * | 6/2008 | Kubota et al. | 251/129.05 |
| 7,431,226 | B2 * | 10/2008 | Cho et al. | 239/585.1 |
| 2002/0053338 | A1 * | 5/2002 | Rembold et al. | 123/357 |
| 2006/0130813 | A1 * | 6/2006 | Dolker | 123/458 |
| 2007/0227506 | A1 * | 10/2007 | Perryman et al. | 123/479 |
| 2008/0017173 | A1 * | 1/2008 | Fujii | 123/478 |

FOREIGN PATENT DOCUMENTS

| | | | | |
|---|---|---|---|---|
| DE | 102 35 196 | | 2/2004 | |
| DE | 10235196 | A1 * | 2/2004 | G05B 7/02 |
| DE | 10 2006 043 677 | | 6/2007 | |
| DE | 102006043677 | A1 * | 6/2007 | |
| DE | 102006002893 | B3 * | 7/2007 | G05B 13/02 |
| DE | 10 2007 020 968 | | 11/2008 | |
| DE | 102007020968 | A1 * | 11/2008 | F02D 41/20 |
| EP | 1201898 | A1 * | 5/2002 | F02D 41/20 |
| EP | 1270913 | A2 * | 1/2003 | F02D 41/20 |
| EP | 1990526 | A2 * | 11/2008 | F02D 41/20 |
| FR | 2830287 | A1 * | 4/2003 | F02M 59/36 |
| JP | 2001-207878 | | 8/2001 | |
| JP | 2003-148229 | | 5/2003 | |
| JP | 2003-161226 | | 6/2003 | |
| WO | WO 2004005687 | A1 * | 1/2004 | F02D 41/20 |
| WO | WO 2006107432 | A1 * | 10/2006 | |
| WO | WO 2007085500 | A1 * | 8/2007 | |

* cited by examiner

METHOD FOR OPERATING A FUEL INJECTION SYSTEM OF AN INTERNAL COMBUSTION ENGINE

FIELD OF THE INVENTION

The present invention relates to a method for operating a fuel system of an internal combustion engine and to a computer program and an electrical memory medium as well as a control and regulating unit.

BACKGROUND INFORMATION

DE 101 48 218 describes a method for operating a fuel injection system using a quantity control valve. The known quantity control valve is implemented as a solenoid valve which is operated electromagnetically by a solenoid and has a magnetic armature and corresponding path-limiting stops. The known solenoid valve is open in the energized state of the coil. However, such quantity control valves, which are closed in the currentless state of the solenoid, are also known from the market. In the latter case the solenoid is triggered using a constant voltage or a clocked voltage (pulse width modulation, "PWM") to open the quantity control valve so that the current in the solenoid increases in a characteristic manner. After switching off the voltage the current drops again in a characteristic manner, so that the quantity control valve closes (in the case of a valve that is closed when currentless) or opens (in the case of a valve which is opened when currentless).

In the case of the valve which is closed when currentless, as disclosed in DE 101 48 218, to prevent the armature from striking against the stop at full speed during the opening movement of the quantity control valve, which could result in distinct noise development, the electromagnetic operating device is energized again in a pulsed manner shortly before the end of the opening movement. As a result of this current pulse, a braking force is exerted on the armature even before it comes in contact with the stop. The braking force reduces the speed, thereby minimizing the noise of stopping.

SUMMARY

Example embodiments of the present invention provide a method for operating a fuel injection system of an internal combustion engine in which a preferably low noise operation of the fuel injection system is achieved.

Features of example embodiments of the present invention are found in the following description and in the drawings, and these features may be provided either alone or in various combinations without reference being made explicitly thereto.

The magnetic operating device may differ from one model to another. The reasons for this are, on the one hand, manufacturing tolerances but also environmental parameters, which may vary from one fuel injection system to another and in particular from one operating situation of a fuel injection system to another. In particular it has been recognized that it is possible to differentiate between quick pick-up, i.e., efficient, electromagnetic operating devices and slow-pick-up, i.e., rather inefficient, electromagnetic operating devices. These variances could previously result in a suboptimal braking pulse. This risk is ruled out or at least greatly reduced with example embodiments of the present invention.

Furthermore, the braking pulse may also depend, for example, on a supply voltage of a voltage source and/or a temperature of a component of the fuel injection system in particular or of the internal combustion engine. This is also taken into account through example embodiments of the present invention, for example, via an engine characteristics map which may be determined for a nominal quantity control valve as a function of a nominal temperature-dependent resistance and the voltage of a voltage source, for example, an automotive battery. The reason for taking into account the temperature is that the electrical resistances of electrical lines via which the quantity control valve is connected to an output stage of a control unit depends on the prevailing temperature of these electrical lines. This may be taken into account through the method according to example embodiments of the present invention.

Example embodiments of the present invention therefore make it possible to reduce the impact speed of the valve element against a stop and therefore the noise during operation of the quantity control valve. By using an adaptation method, this is achievable for individual quantity control valves, so that the requirements on the manufacturing tolerance may be reduced. The costs for manufacturing the fuel injection system may also be reduced in this manner. In repeated use of the method according to example embodiments of the present invention over the lifetime of the high-pressure pump, it is also possible to compensate for effects due to aging and/or wear, so that robust operation over the entire lifetime of the quantity control valve is achieved. In addition to reducing noise emissions, dispersal of the noise is minimized, as measured over a given random sample. Specified upper limits for noise may therefore be reliably observed. By reducing the impact speed, the load on the stops is reduced. This also lowers the corresponding load spectrum, so that requirements concerning the wear and strength of the quantity control valve may be lower. This in turn lowers costs. Furthermore, the risk of failures is reduced. Additional hardware for implementing the method according to example embodiments of the present invention is not necessary, so there are no additional parts costs in this respect.

Particularly suitable parameters of the braking pulse include: the start of the braking pulse, the duration of a PWM phase (PWM=pulse width modulation) or a current-controlled phase of the braking pulse, the duration of a pick-up pulse occurring before the first PWM phase, the pulse duty factor or current level during a holding phase of the braking pulse, the pulse duty factor or current level at the end of a holding phase of the braking pulse.

If the pulse duty factor or the current level is increased at the end of a holding phase of the braking pulse, it also has effects on the braking pulse. This may be achieved by a change in the pulse duty factor in the case of a discrete output stage, or by control of the current level in the case of a current-controlled output stage. Output stages in which the current-controlled phases and PWM-controlled phases are in alternation are also conceivable. These intervention options may be used in sections here for outputting an adapted braking pulse.

For noise reduction overall, it is advantageous if the braking pulse occurs later and/or has a shorter duration and/or is weaker in the case of an electromagnetic operating device having a higher level of efficiency than in the case of an electromagnetic operating device having a lower level of efficiency.

To detect whether the solenoid valve is no longer closing or is just now opening, a deviation of an actual pressure in the fuel rail from a setpoint pressure may be used. In the case of a currentless, open quantity control valve, for example, this is based on the idea that when the current feed of the electromagnetic operating device in the adaptation method has dropped to the extent that the quantity control valve is no longer closing, there will be a pressure drop or even a pressure collapse in the fuel rail because then the high-pressure pump will no longer be delivering any fuel.

The parameter of a braking pulse may also be the shape of the braking pulse, which is easily defined by sequences of multiple PWM phases, multiple pick-up pulse phases without PWM, current-controlled phases, defined stage quenches and/or Zener quenches.

Another measure for reducing noise emissions consists of the fact that an energized holding phase of the electromagnetic operating device begins before a delivery stroke but is terminated only shortly after the end of the delivery stroke. This reduces tolerances in the movement of a piston of the high-pressure pump and thus the position of the top dead center between the delivery phase and the intake phase.

To prevent an imbalanced sound impression due to stochastic effects when using a discrete output stage, i.e., triggering the electromagnetic operating device using pulse width modulation, it is proposed that a holding phase be terminated at a defined, for example, a falling, PWM flank. The start of quenching of the coil current at a defined current level is thus initiated. The valve element therefore drops in a reproducible manner, so that any variation in the effect of the braking pulse is prevented.

Example embodiments of the present invention are explained in greater detail below with reference to the accompanying drawings.

DETAILED DESCRIPTION

Figure 1:
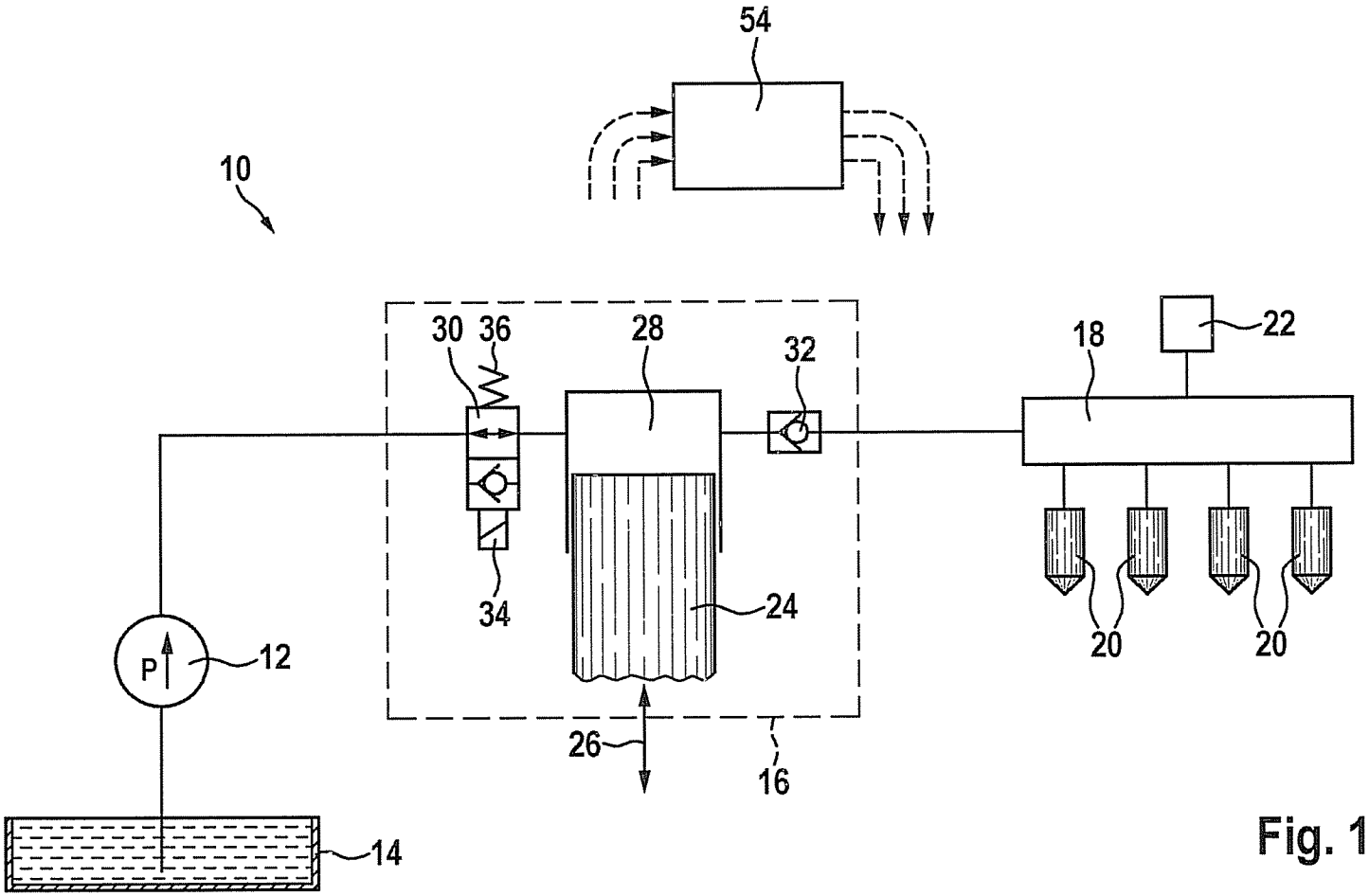
FIG. 1 shows a schematic diagram of a fuel injection system of an internal combustion engine having a high-pressure pump and a quantity control valve.

A fuel injection system in FIG. 1 is labeled overall using reference numeral 10. It includes an electrical fuel pump 12, using which fuel is delivered from a fuel tank 14 to a high-pressure pump 16. High-pressure pump 16 compresses the fuel to a very high pressure and delivers it further into a fuel rail 18. A plurality of injectors 20 is connected to this fuel rail, injecting fuel into combustion chambers assigned to the injectors. The pressure in fuel rail 18 is detected by a pressure sensor 22.

High-pressure pump 16 is a piston pump having a delivery piston 24, which may be induced to move back and forth (double arrow 26) by a camshaft (not shown). Delivery piston 24 delimits a delivery chamber 28 which may be connected via a quantity control valve 30 to the outlet of electrical fuel pump 12. Delivery chamber 28 may also be connected to fuel rail 18 via an outlet valve 32.

Figure 2:
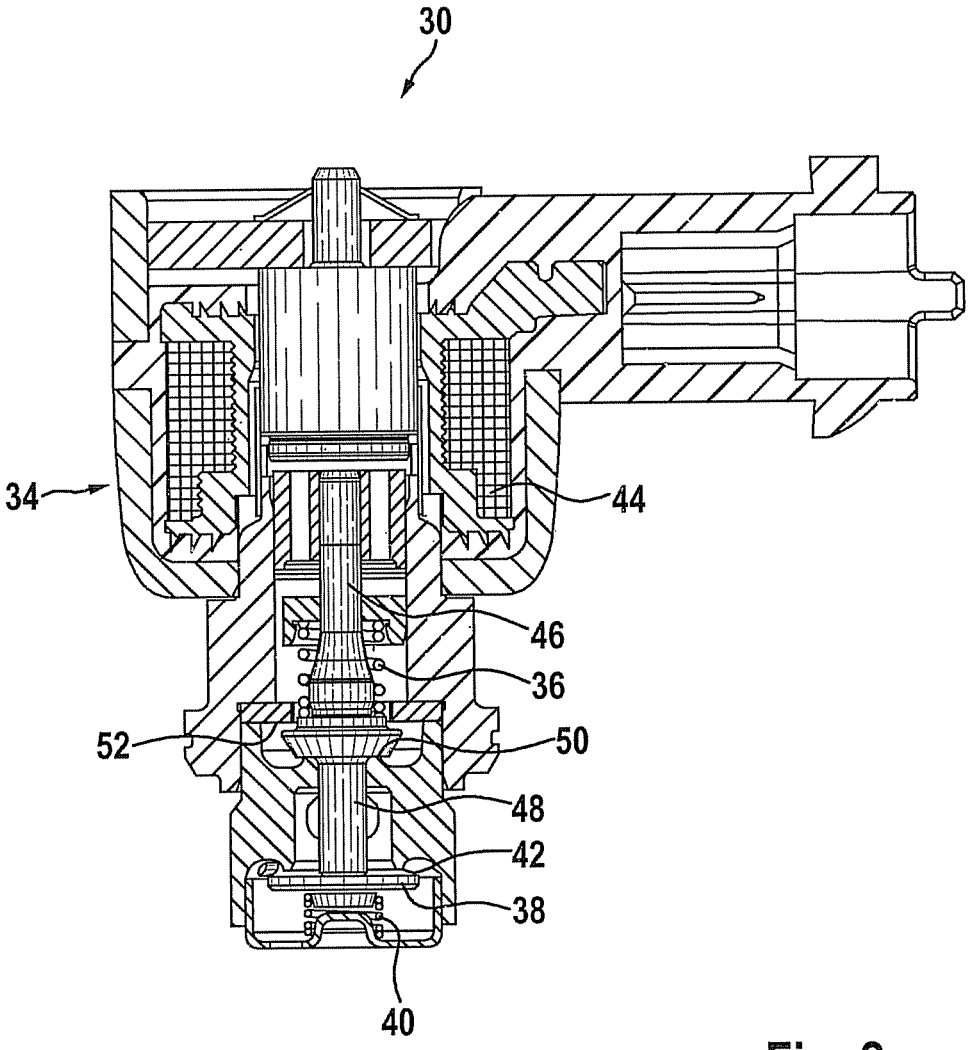
FIG. 2 shows a partial section through the quantity control valve of FIG. 1.

Quantity control valve 30 includes an electromagnetic operating device 34, which in the energized state operates against the force of a spring 36. Quantity control valve 30 is open in the currentless state; in the energized state, it has the function of a normal intake nonreturn valve. FIG. 2 shows the detailed arrangement of quantity control valve 30.

Quantity control valve 30 includes a disk-shaped valve element 38, which is acted upon by a valve spring 40 against a valve seat 42. These three elements form the intake nonreturn valve mentioned above.

Electromagnetic operating device 34 includes a solenoid 44, which cooperates with an armature 46 of an actuating tappet 48. Spring 36 acts upon actuating tappet 48 against valve element 38 when solenoid 44 is currentless, forcing the valve element into its open position. The corresponding end position of actuating tappet 48 is defined by a first stop 50. When the solenoid is energized, actuating tappet 48 is moved away from valve element 38 against the force of spring 36 toward a second stop 52.

Figure 3:
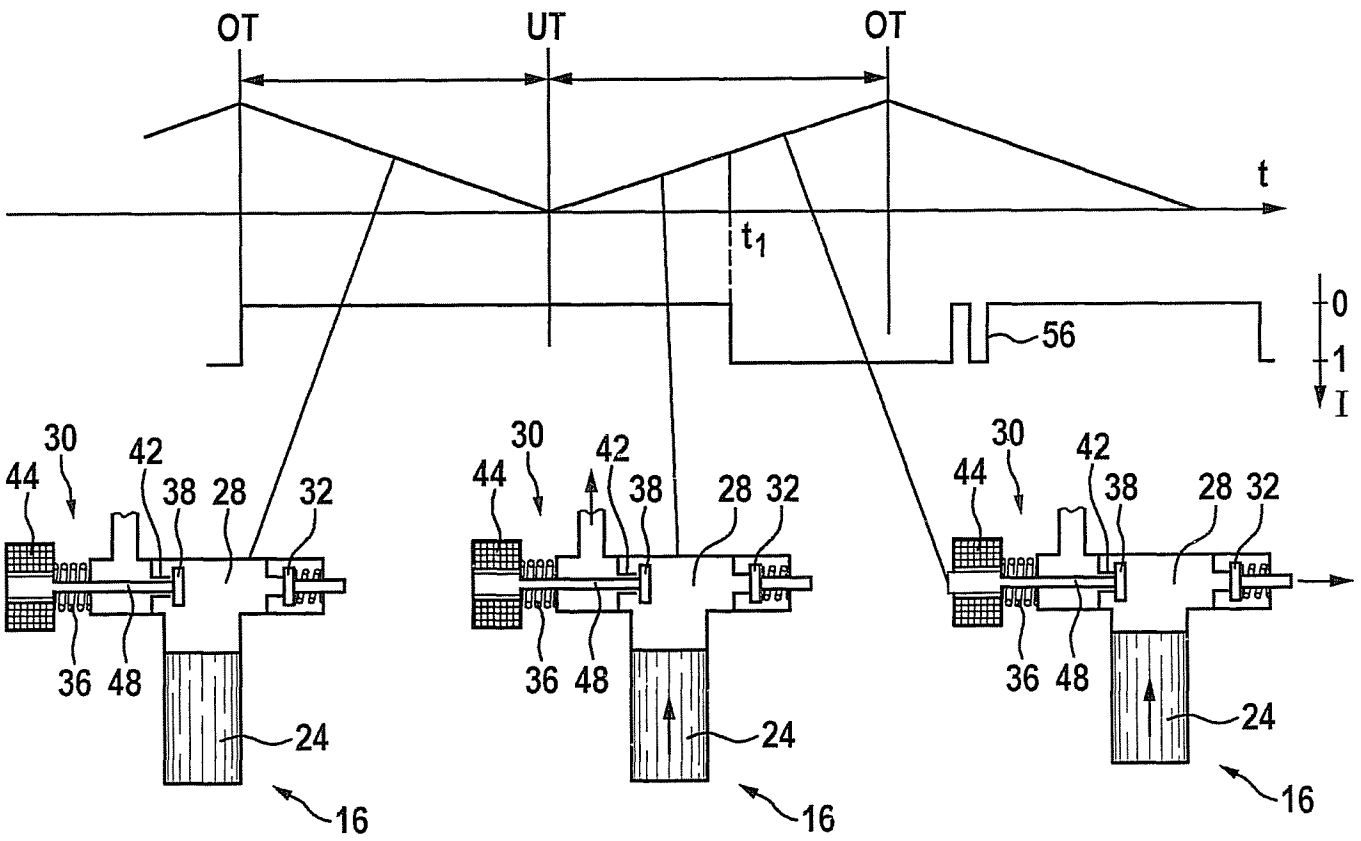
FIG. 3 shows a schematic diagram of various function states of the high-pressure pump and the quantity control valve of FIG. 1 having a corresponding time diagram.

High-pressure pump 16 and quantity control valve 30 operate as follows (see FIG. 3):

At the top of FIG. 3, a lift of piston 34 is plotted as a function of time, and below that, the current feed of solenoid 44 is plotted as a function of time. Furthermore, high-pressure pump 16 is shown schematically in various operating states. During an intake stroke (left diagram in FIG. 3), solenoid 44 is currentless, so that actuating tappet 48 is forced by spring 36 against valve element 38, moving it into its open position. In this manner, fuel may flow from electrical fuel pump 12 into delivery chamber 28. The delivery stroke of delivery piston 24 begins after reaching bottom dead center BDC. This is shown in the middle of FIG. 2. Solenoid 44 continues to be currentless, so that quantity control valve 30 is still forcibly open. Fuel is ejected by delivery piston 24 via opened quantity control valve 30 to electrical fuel pump 12. Outlet valve 32 remains closed. There is no delivery into fuel rail 18. Solenoid 44 is energized at a point in time $t_1$, so that actuating tappet 48 is pulled away from valve element 38. It should be pointed out here that the curve of the current feed of solenoid 44 is only shown schematically in FIG. 3. As will be explained further below, the actual coil current is not constant but is instead dropping due to mutual induction effects under some circumstances. In the case of a pulse-width-modulated trigger voltage, the coil current, moreover, is undulating or jagged.

Due to the pressure in delivery chamber 28, valve element 38 is in contact with valve seat 42; quantity control valve 30 is thus closed. Now a pressure is able to build up in delivery chamber 28, resulting in the opening of outlet valve 32 and delivery into fuel rail 18. This is shown at the far right of FIG. 3. Shortly after reaching top dead center TDC of delivery piston 24, the current feed of solenoid 44 is terminated, so that quantity control valve 30 again reaches its forcibly open position.

The quantity of fuel delivered from high-pressure pump 16 to fuel rail 18 is influenced by varying point in time $t_1$. Point in time $t_1$ is established by a control and regulating device 54 (FIG. 1), such that an actual pressure in fuel rail 18 corresponds to a setpoint pressure as accurately as possible. To this end, signals supplied by pressure sensor 22 are processed in control and regulating device 54.

After termination of the current feed of solenoid 44, actuating tappet 48 is again moved toward first stop 50. To reduce the rate of impact against first stop 50, a braking pulse 56 is generated by which the rate of movement of actuating tappet 48 is reduced just before striking first stop 50.

In the case of fuel injection system 10 shown in FIG. 1, at least one parameter of braking pulse 56 depends on the efficiency of electromagnetic operating device 34. This efficiency is determined in an adaptation method which will now be explained with reference to FIG. 4. According to this, a pulse duty factor of a pulse-width-modulated trigger voltage is set to a first value after a first so-called "pick-up pulse" 58 after a first working cycle of high-pressure pump 16 (working cycle includes an intake stroke and a delivery stroke); this value ensures that actuating tappet 48 is pulled away from valve element 38. The corresponding curve of the coil current is labeled as 60*a* in FIG. 4. It is apparent here that a mutual induction is generated in solenoid 44 due to the movement of actuating tappet 48 and armature 46 linked to it, resulting in a reduction in the effective coil current. The movement of actuating tappet 48 and of valve element 38, i.e., their lift H, is labeled as 62*a* for this case in FIG. 4.

Figure 4:
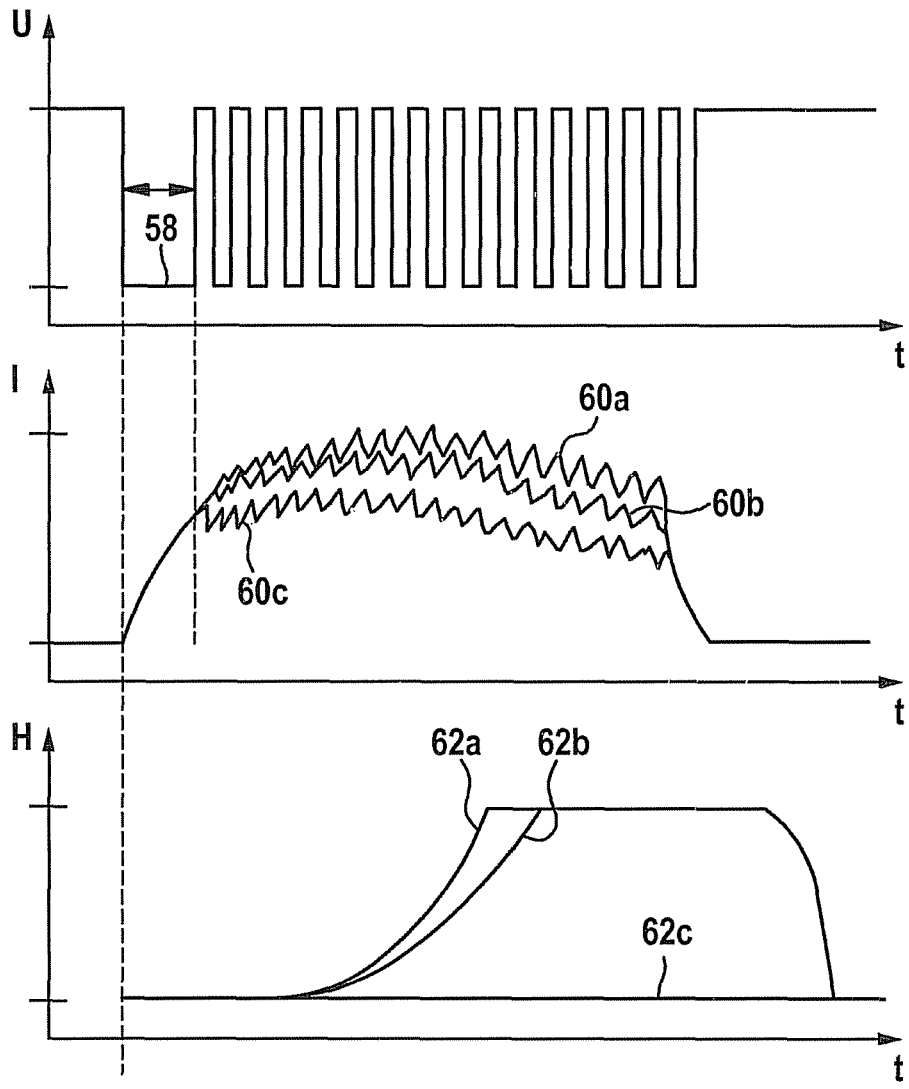
FIG. 4 shows three diagrams in which a trigger voltage, a current feed of a solenoid, and a lift of a valve element of the quantity control valve of FIG. 1 are plotted as a function of time, in performing an adaptation method.

In the following working cycle, the pulse duty factor is set such that a lower effective current feed of solenoid 44 is the result corresponding to a curve 60*b* in FIG. 4. Subsequently this yields a delayed movement of actuating tappet 48 and valve element 38 corresponding to curve 62*b*. The pulse duty factor is changed further successively so that the effective coil current drops further. In the case of a coil current shown as curve 60*c* as an example, corresponding to a "limiting pulse duty factor," actuating tappet 48 is no longer moved adequately away from valve element 38; quantity control valve 30 thus remains open (curve 62*c*). Thus there is no delivery of fuel into fuel rail 18. This in turn results in a great drop in pressure in fuel rail 18, i.e., a great and sudden deviation of the actual pressure in fuel rail 18 from the setpoint pressure, due to the fuel flowing out of fuel rail 18 via injectors 20, and this is detected by control and regulating device 54. Using this adaptation method, it is thus possible to ascertain the pulse duty factor at which quantity control valve 30 just no longer opens or just barely opens.

This limiting pulse duty factor, which may also be referred to as a "final value," is used to characterize the efficiency of electromagnetic operating device 34. A quantity control valve 30 having a rather efficient electromagnetic operating device 34 has a lower final value than a quantity control valve 30 having a rather inefficient electromagnetic operating device 34. The efficiency of individual electromagnetic operating device 34 thereby established is then used for parameterization of braking pulse 56. In addition, the level of a supply voltage of a battery in a motor vehicle, for example, in which the internal combustion engine is installed, and a temperature of the fuel, for example, are additionally used for parameterization of the braking pulse. A start of the braking pulse, a duration of a pulse-width-modulated phase, or the duration of a current-controlled phase of braking pulse 56 (in the case of a current-controlled output stage) may as the parameter of braking pulse 56. The duration of pick-up pulse 58 occurring before the pulse-width-modulated phase may be one such parameter; furthermore, such a parameter may also be a pulse duty factor or a current level during the holding phase before braking pulse 56 and/or a pulse duty factor or a current level at the end of the holding phase before braking pulse 56.

Figure 5:
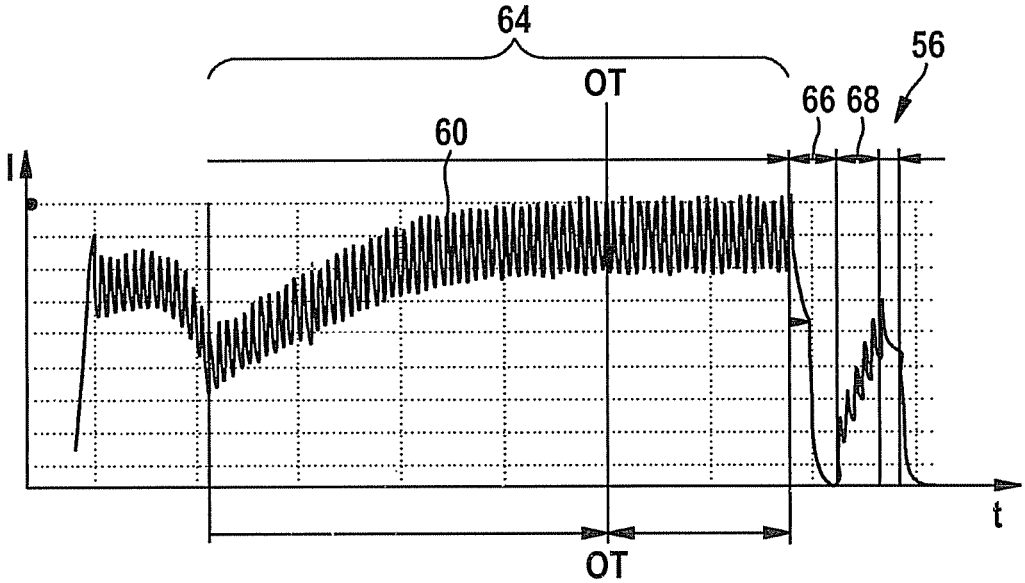
FIG. 5 shows a diagram in which a curve of a current feed of the quantity control valve of FIG. 1 is plotted as a function of time during the implementation of a braking pulse.
Figure 6:
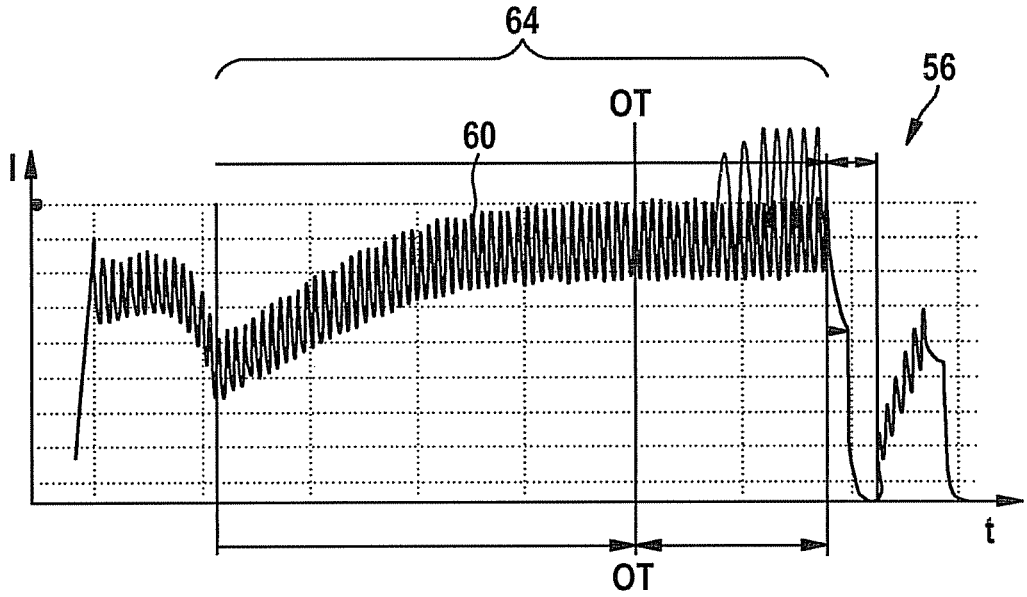
FIG. 6 shows a diagram similar to that in FIG. 5 in one variant of the current curve.

Reference is now made to FIG. 5, which shows a coil current 60 plotted as a function of time, including braking pulse 56. This shows a holding phase 64, which extends beyond top dead center into the intake phase. This shows that holding phase 64 is terminated at a falling flank of the pulse-width-modulated voltage signal. The current initially drops freely ("free-wheeling") before a rapid quench is performed by applying a countercurrent. Free-wheeling and rapid quenching occur within a period of time 66, which elapses from the end of the holding phase to the start of braking pulse 56. Braking pulse 56 itself will in turn be generated by a pulse-width-modulated signal whose duration is labeled as 68 in FIG. 5. As is apparent in FIG. 6, the pulse duty factor may be modified at the end of holding phase 64 such that it yields an increase in effective coil current 60. The shape of braking pulse 56 may be defined by sequences of a plurality of pulse-width-modulated phases, pick-up pulse phases without pulse-with-modulation, current-controlled phases, defined stage quenches and/or Zener quenches. For noise reduction overall, braking pulse 56 will occur rather later and/or has a shorter duration and/or is weaker in the case of an electromagnetic operating device 34 having a higher level of efficiency than in the case of an electromagnetic operating device 34 having a lower level of efficiency.

Figure 7:
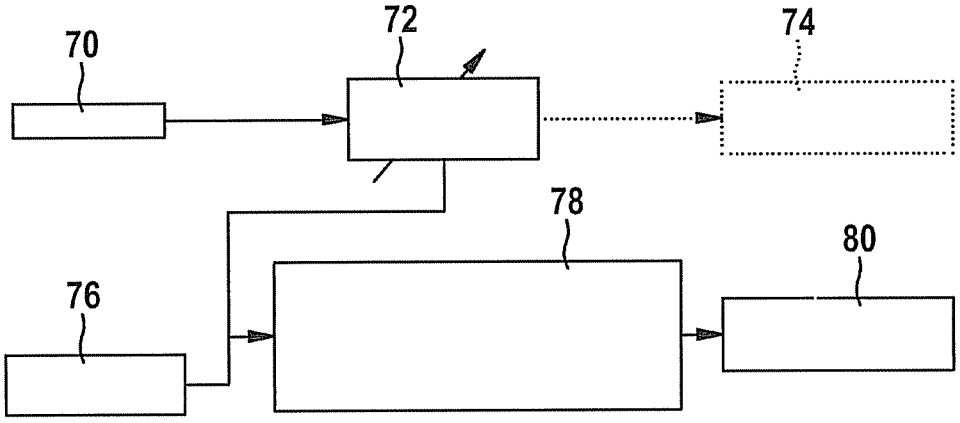
FIG. 7 shows a flow chart of a method for operating the fuel injection system of FIG. 1.

FIG. 7 represents a method for operating fuel injection system 10. The actual pressure in fuel rail 18 is compared with the setpoint pressure in 70 on the basis of the signal of pressure sensor 22. Using the adaptation method explained above in conjunction with FIG. 4, the final value of the pulse duty factor is ascertained in 72 and a variable characterizing the efficiency of electromagnetic operating device 34 is ascertained from this. By using such a pulse duty factor, which is just barely sufficient to close quantity control valve 30, a reduced speed in the stopping of actuating tappet 48 on second stop 52 and thereby a noise reduction are achieved (block 74). The voltage of the vehicle battery and the temperature of the fuel are detected in 76. These detected values together with the efficiency of electromagnetic operating device 34 ascertained in the method of 72 are used for parameterization of braking pulse 56 in 78. This yields a noise reduction in the stopping of actuating tappet 48 on first stop 50 in 80.

In the case of an example embodiment (not shown), a braking pulse is generated only below a certain rotational speed of a crankshaft of the internal combustion engine or a drive shaft of high-pressure pump 16. In another specific embodiment (not shown), the braking pulse is also generated above such a rotational speed, but there is no longer any adaptation of the braking pulse above this rotational speed.

What is claimed is:

1. A method for operating a fuel injection system of an internal combustion engine, comprising:

ascertaining a pulse duty factor at which a quantity control valve one of just no longer opens and just barely opens;

delivering fuel by a high-pressure pump into a fuel rail; and influencing a quantity of the delivered fuel by the quantity control valve operated by an electromagnetic operating device, at least one parameter of a braking pulse of the electromagnetic operating device depending on both an efficiency of the electromagnetic operating device and also at least one of (a) a voltage of a voltage source, (b) a temperature, and (c) a temperature of at least one component of at least one of (i) the fuel injection system and (ii) the internal combustion engine;

wherein at least one level of efficiency of the electromagnetic operating device is characterized as having one of a high level of efficiency and a low level of efficiency according to the ascertained pulse duty factor, and wherein, responsive to the at least one level of efficiency being characterized as having the high level of efficiency, the braking pulse at least one of (a) occurs later, (b) has a shorter duration, and (c) is weaker, than in a case of an electromagnetic operating device having a lower level of efficiency, and wherein, responsive to the at least one level of efficiency being characterized as having the low level of efficiency, the braking pulse at least one of (a) occurs earlier, (b) has a longer duration, and (c) is stronger, than in a case of an electromagnetic operating device having a higher level of efficiency.

2. The method according to claim 1, wherein a power supplied to the electromagnetic operating device is altered successively in an adaptation method from a starting value at a start time to a final value at a final time, wherein the final time is when the quantity control valve is one of no longer or just barely detected as being open or closed.

3. The method according to claim 1, wherein the at least one parameter of the braking pulse includes at least one of a start of the braking pulse, a duration of a pulse width modulation phase or a current-controlled phase of the braking pulse, a duration of a pick-up pulse before the first pulse width modulation phase, a pulse duty factor or a current level during a holding phase before the braking pulse, and a pulse duty factor or a current level at the end of a holding phase before the braking pulse.

4. The method according to claim 1, wherein an opening or closing of the quantity control valve is detected by monitoring a deviation of an actual pressure in the fuel rail from a setpoint pressure.

5. The method according to claim 1, wherein a shape of the braking pulse is defined by at least one of sequences of a plurality of pulse width modulation phases, pick-up pulse phases without pulse width modulation, current controlled phases, defined stage quenches, and Zener quenches.

6. The method according to claim 1, wherein an energized holding phase of the electromagnetic operating device begins during a delivery stroke and wherein the energized holding phase of the electromagnetic operating device is terminated after the end of the delivery stroke.

7. The method according to claim 1, wherein a holding phase is terminated at a defined pulse width modulation flank during triggering with pulse width modulation.

8. A non-transitory computer-readable storage medium, for at least one of (a) a control device and (b) a regulating device of a fuel injection system, with an executable program stored thereon, wherein the program is executed by a microprocessor to perform the following steps:

ascertaining a pulse duty factor at which a quantity control valve one of just no longer opens and just barely opens;

delivering fuel by a high-pressure pump into a fuel rail; and influencing a quantity of the delivered fuel by the quantity control valve operated by an electromagnetic operating device, at least one parameter of a braking pulse of the electromagnetic operating device depending on both an efficiency of the electromagnetic operating device and also at least one of (a) a voltage of a voltage source, (b) a temperature, and (c) a temperature of at least one component of at least one of (i) the fuel injection system and (ii) the internal combustion engine;

wherein at least one level of efficiency of the electromagnetic operating device is characterized as having one of a high level of efficiency and a low level of efficiency according to the ascertained pulse duty factor, and wherein, responsive to the at least one level of efficiency being characterized as having the high level of efficiency, the braking pulse at least one of (a) occurs later, (b) has a shorter duration, and (c) is weaker, than in a case of an electromagnetic operating device having a lower level of efficiency, and wherein, responsive to the at least one level of efficiency being characterized as having the low level of efficiency, the braking pulse at least one of (a) occurs earlier, (b) has a longer duration, and (c) is stronger, than in a case of an electromagnetic operating device having a higher level of efficiency.

9. A device for at least one of controlling and regulating a fuel injection system, the device to perform, upon execution by a microprocessor, the following steps:

ascertaining a pulse duty factor at which a quantity control valve one of just no longer opens and just barely opens;

delivering fuel by a high-pressure pump into a fuel rail; and influencing a quantity of the delivered fuel by the quantity control valve operated by an electromagnetic operating device, at least one parameter of a braking pulse of the electromagnetic operating device depending on both an efficiency of the electromagnetic operating device and also at least one of (a) a voltage of a voltage source, (b) a temperature, and (c) a temperature of at least one component of at least one of (i) the fuel injection system and (ii) the internal combustion engine;

wherein at least one level of efficiency of the electromagnetic operating device is characterized according to the ascertained pulse duty factor, and wherein, responsive to the at least one level of efficiency being characterized as having the high level of efficiency, the braking pulse at least one of (a) occurs later, (b) has a shorter duration, and (c) is weaker, than in a case of an electromagnetic operating device having a lower level of efficiency, and wherein, responsive to the at least one level of efficiency being characterized as having the low level of efficiency, the braking pulse at least one of (a) occurs earlier, (b) has a longer duration, and (c) is stronger, than in a case of an electromagnetic operating device having a higher level of efficiency.

10. The method according to claim 7, wherein the defined pulse width modulation flank is a falling PWM flank.

11. The method of claim 1, wherein at least one of the voltage of the voltage source and the temperature of the at least one component of at least one of the fuel injection system and (b) the internal combustion engine affects the braking pulse according to an engine characteristics map.

12. The method of claim 2, wherein the final value or a variable based on the final value is used to characterize the efficiency of the electromagnetic operating device.

* * * * *